US005501087A

United States Patent [19]

Keller

[11] Patent Number: 5,501,087

[45] Date of Patent: Mar. 26, 1996

[54] ROTARY LOCKING CYLINDER FOR A SAFETY LOCK

[76] Inventor: Ernst Keller, Untere Schwandenstrasse 22, CH-8805 Richterswil, Switzerland

[21] Appl. No.: 230,104

[22] Filed: Apr. 20, 1994

[30] Foreign Application Priority Data

May 27, 1993 [CH] Switzerland ..... 1588/93

[51] Int. Cl.[6] ..... E05B 9/08

[52] U.S. Cl. ..... 70/370; 70/466

[58] Field of Search ..... 70/370–374, 229–231, 70/451, 466, DIG. 60

[56] References Cited

U.S. PATENT DOCUMENTS

| | | | |
|---|---|---|---|
| 1,008,533 | 11/1911 | Fletcher | 70/374 |
| 2,218,126 | 10/1940 | Thacher | 70/231 |
| 2,996,909 | 8/1961 | Raye | 70/371 |
| 3,293,892 | 12/1966 | Falk | 70/370 |
| 3,974,671 | 8/1976 | Rossetti | 70/375 |
| 4,715,201 | 12/1987 | Craig | 70/373 |
| 4,850,210 | 7/1989 | Adler | 70/373 |

FOREIGN PATENT DOCUMENTS

| | | | |
|---|---|---|---|
| 0022233 | 1/1981 | European Pat. Off. . | |
| 22233 | 1/1981 | European Pat. Off. | 70/DIG. 60 |
| 438654 | 7/1991 | European Pat. Off. | 70/373 |
| 7800771 | 1/1978 | Netherlands | 70/DIG. 60 |
| 679169A5 | 12/1991 | Switzerland . | |
| 1581095 | 12/1980 | United Kingdom | 70/DIG. 60 |
| WO9101425 | 2/1991 | WIPO | 70/373 |

*Primary Examiner*—Steven N. Meyers
*Assistant Examiner*—Gary Estremsky
*Attorney, Agent, or Firm*—McAulay Fisher Nissen Goldberg & Kiel

[57] ABSTRACT

A rotary locking cylinder for a safety lock has a housing and a crosspiece. A recess is incorporated in the crosspiece from the top, a locking element being inserted into this recess. The recess connects an upper outer side of the crosspiece with a transverse bore hole in an arm of the crosspiece. In the assembled state, the crosspiece is inserted into a recess of the cylinder pocket and connected with a transverse pin. In order to secure the transverse pin against longitudinal displacement in the cylinder pocket, this transverse pin has a circumferential groove in which the locking element engages from above. In order to exchange the crosspiece, the rotary locking cylinder is rotated about its longitudinal axis in such a way that the cylinder pocket is on top. During rotation, the locking element falls downward due to the force of gravity and releases the transverse pin. The rotary locking cylinder can be lengthened or shortened at the installation site without a reduction in strength by exchanging the crosspiece.

5 Claims, 1 Drawing Sheet

ROTARY LOCKING CYLINDER FOR A SAFETY LOCK

BACKGROUND OF THE INVENTION a) Field of the Invention

The invention is directed to a rotary locking cylinder for a safety lock with a cylinder housing and a crosspiece which is inserted into a recess of the cylinder housing and secured by a transverse pin.

b) Background Art

Rotary locking cylinders of this type are well known. In a double rotary locking cylinder, the connection crosspiece connects two identical rotary locking cylinders. A lock can then be operated from both sides of the door. Double rotary locking cylinders with a connection crosspiece are particularly advantageous in that they can be made longer or shorter at the installation site. For this purpose, the crosspiece is replaced by one with a different length. However, as a result, the connection between the connection crosspiece and rotary locking cylinder can easily be detached. But for security reasons this connection should not be detachable from the outside when the rotary locking cylinder is installed.

OBJECTS AND SUMMARY OF THE INVENTION

The present invention has, as a primary object, the developing of a rotary locking cylinder, in particular, a double rotary locking cylinder, in such a way that the connection crosspiece can be exchanged easily but the connection between the connection crosspiece and cylinder housing cannot be detached when the rotary locking cylinder is installed.

This object is met in a rotary locking cylinder according to the invention in that a locking element is arranged in a recess of the crosspiece so as to be displaceable via the transverse pin and this locking element engages in a recess of the transverse pin so as to secure it against displacement in the longitudinal direction. In order to replace the lengthening crosspiece, the rotary locking cylinder is rotated around its longitudinal axis in such a way that the cylinder pocket is on top. The locking element falls downward somewhat in the recess of the crosspiece, possibly after being shaken slightly, so that the locking element disengages from the transverse pin. The disengaged transverse pin can now be removed and the lengthening crosspiece can be taken out of the cylinder. When the rotary locking cylinder is rotated into the customary position, the locking element falls down again and engages in the recess of the transverse pin so as to prevent displacement of the latter. The lengthening crosspiece can easily be replaced again in the same manner. The rotary locking cylinder according to the invention is therefore suitable preferably for a modular system in which the lock cylinder can be lengthened or shortened at the installation site. Since a rotary locking cylinder cannot normally be rotated after it is installed, it is also not possible to undo the connection between the lengthening crosspiece and the rotary locking cylinder.

An embodiment example of the rotary locking cylinder according to the invention is explained in more detail in the following with reference to the drawing.

DESCRIPTION OF THE PREFERRED EMBODIMENTS

Figure 1:
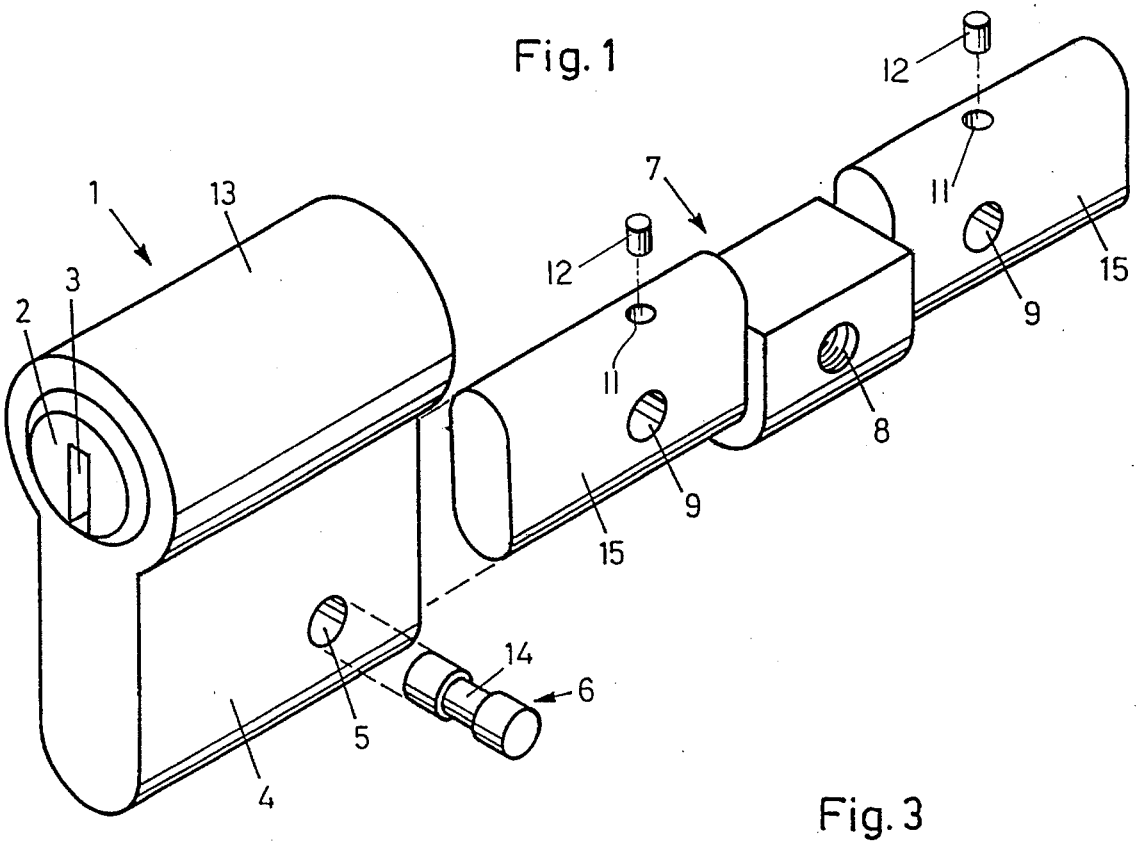
FIG. 1 shows a rotary locking cylinder according to the invention in which individual parts are disassembled for reasons of clarity.

FIG. 1 shows a rotary locking cylinder 1, a connection crosspiece 7 which is preferably produced from unbreakable chromium nickel steel, and a transverse pin 6 which secures the crosspiece 7 in the rotary locking cylinder 1. The rotary locking cylinder 1 has a cylinder housing 13, known per se, with a cylinder pocket 4 and a transverse bore hole 5 for the pin 6. A conventional rotor 2 with a key slot 3 is supported in the cylinder housing 13. Conventional tumblers which can be brought into line with an appropriate key are accommodated in the rotary locking cylinder 1.

The crosspiece 7 has two arms 15, possibly of different length, in which is incorporated a transverse bore hole 9 for receiving a transverse pin 6. A conventional threaded bore hole 8 for receiving a lock screw, not shown in the drawing, is arranged between the arms 15. In a double rotary locking cylinder, the arms 15 are inserted into a corresponding recess 10 of a rotary locking cylinder 1, which recess 10 is open on the rear side of the housing 13.

Figure 2:
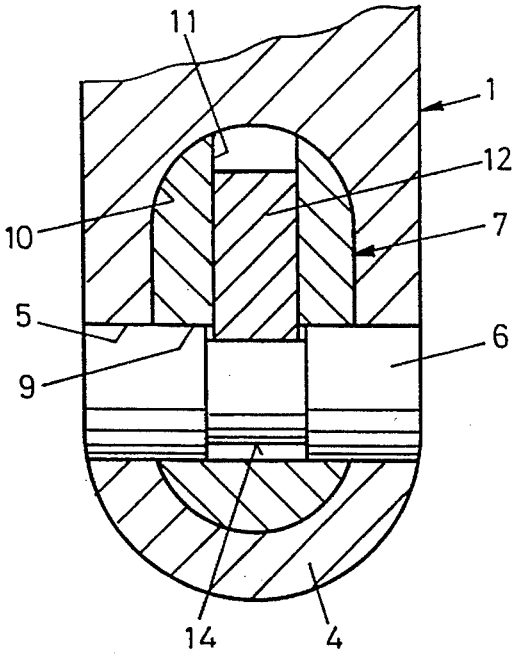
FIG. 2 shows a partial section through a rotary locking cylinder according to the invention.
Figure 3:
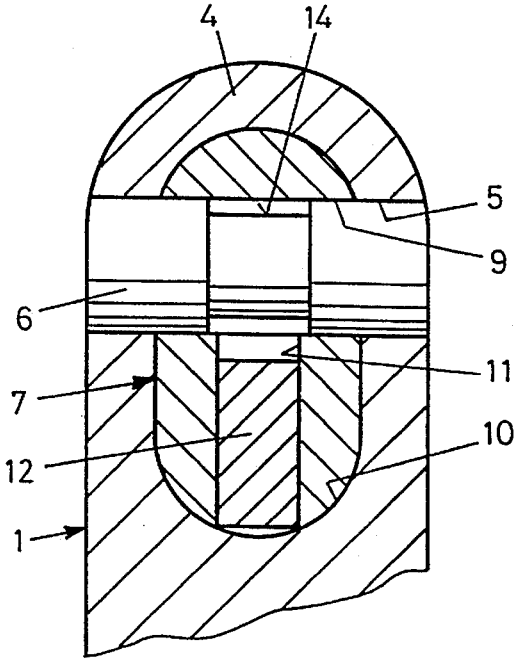
FIG. 3 shows a section corresponding to FIG. 2, but with rotated rotary locking cylinder.

In the installed state, the connection crosspiece 7 according to FIG. 2 is securely connected with the two rotary locking cylinders 1. As will be seen, the transverse pin 6 passes through the bore hole 5 of the cylinder housing 13 and through a bore hole 9 of the crosspiece 7. A locking element 12, for example, a simple cylindrical pin, is inserted into a bore hole 11 of the crosspiece 7 and engages by its lower end in a circumferential groove 14 of the transverse pin 6. The locking element 12 accordingly prevents a displacement of the transverse pin 6 in the cylinder pocket 4 and consequently prevents the connection crosspiece 7 from disengaging from the cylinder housing 13. When the rotary locking cylinder 1 with the installed connection crosspiece 7 is installed in a door, not shown in the drawing, the cylinder pocket 4 is at the bottom as seen in FIG. 1 and the locking element 12 engages with the transverse pin 6 as shown in FIG. 2. When the rotary locking cylinder 1, before it is installed in a door, is rotated about its longitudinal axis in such a way that the cylinder pocket 4 is on top with reference to FIG. 3, the locking element 12 moves downward due to force of gravity in the recess or bore hole 11 into the position shown in FIG. 3. As can be seen, the locking element does not engage with the transverse pin 6 in this position. Accordingly, in this position of the rotary locking cylinder 1, the transverse pin 6 can be displaced in the cylinder pocket 4 in the longitudinal direction so as to undo the connection between the connection crosspiece 7 and the cylinder housing 13. The locking element 12 remains in the recess 11 during rotation of the rotary locking cylinder 1 and cannot fall out.

The disengaged connection crosspiece 7 can now be replaced by another connection crosspiece and can be locked in the rotary locking cylinder 1 by inserting the transverse pin 6. If the rotary locking cylinder 1 with the new connection crosspiece is rotated again into the customary position shown in FIG. 2, the force of gravity of the locking element 12 causes it to fall automatically into the locking position shown in FIG. 2. After installing the rotary locking cylinder in a door, the locking element 12 is not accessible from the outside and can also not be moved into a releasing position in some other way.

The crosspiece 7 generally connects two identical rotary locking cylinders 1. However, constructions in which the crosspiece 7 connects different rotary locking cylinders are also possible. Finally, it is also possible for the crosspiece 7 to be connected with only one rotary locking cylinder 1.

While the foregoing description and drawings represent the preferred embodiments of the present invention, it will be obvious to those skilled in the art that various changes and modifications may be made therein without departing from the true spirit and scope of the present invention.

What is claimed:

1. A rotary locking cylinder for a safety lock comprising:

a cylinder housing having a recess and a bore communicating with the recess, the cylinder housing being capable of occupying an upright position and an inverted position;

a cross piece having a first bore and a second bore, the second bore communicating with the first bore and the first bore of the cross piece communicating with the bore of the cylinder housing when the cross piece is inserted into the recess of the cylinder housing;

a locking element adapted to be slidably received in the second bore of the cross piece and being capable of occupying a locked position and an unlocked position;

a transverse pin adapted to be slidably inserted into the first bore of the cross piece and the bore of the cylinder housing when the cross piece is inserted into the recess of the cylinder housing;

the locking element engaging the transverse pin and preventing the removal of the transverse pin from the first bore of the cross piece when the locking element occupies the locked position.

2. The rotary locking cylinder of claim 1 wherein the transverse pin includes a recess, the locking element engaging the transverse pin at the recess.

3. The rotary locking cylinder of claim 2 wherein the recess in the transverse pin is a circumferential groove.

4. The rotary locking cylinder of claim 1 wherein the cylinder housing has a predetermined width at the bore of the cylinder housing and wherein the transverse pin has a predetermined length, the predetermined length being less than the predetermined width.

5. The rotary locking cylinder of claim 1 wherein the locking element occupies the unlocked position when the cylinder housing occupies the inverted position.

* * * * *